US007848930B2

(12) United States Patent
Luu

(10) Patent No.: US 7,848,930 B2
(45) Date of Patent: Dec. 7, 2010

(54) CONTROL MECHANISM FOR AUDIO RATE ADJUSTMENT

(75) Inventor: Cam Minh Luu, San Diego, CA (US)

(73) Assignee: Broadcom Corporation, Irvine, CA (US)

( * ) Notice: Subject to any disclaimer, the term of this patent is extended or adjusted under 35 U.S.C. 154(b) by 1086 days.

(21) Appl. No.: 11/581,353

(22) Filed: Oct. 17, 2006

(65) Prior Publication Data

US 2008/0091437 A1 Apr. 17, 2008

(51) Int. Cl.
*G10L 21/00* (2006.01)

(52) U.S. Cl. ..... 704/500; 348/423.1; 700/94

(58) Field of Classification Search ..... 704/500; 386/95–96, 98–99, 47; 348/423.1, 512; 700/94
See application file for complete search history.

(56) References Cited

U.S. PATENT DOCUMENTS 6,714,826 B1 * 3/2004 Curley et al. ..... 700/94
7,006,152 B2 * 2/2006 Demas et al. ..... 348/565
7,084,898 B1 * 8/2006 Firestone et al. ..... 348/14.09
7,502,073 B2 * 3/2009 Umesako ..... 348/555
7,558,462 B2 * 7/2009 Kurita ..... 348/565
2002/0150126 A1 * 10/2002 Kovacevic ..... 370/503
2004/0233938 A1 * 11/2004 Yamauchi ..... 370/537
2005/0175322 A1 * 8/2005 Demas et al. ..... 386/95
2006/0176963 A1 * 8/2006 Barthel et al. ..... 375/240.28
2006/0248559 A1 * 11/2006 Michener et al. ..... 725/67
2007/0258706 A1 * 11/2007 Raskar et al. ..... 396/52

* cited by examiner

*Primary Examiner*—Daniel D Abebe
(74) *Attorney, Agent, or Firm*—Duane S. Kobayashi

(57) ABSTRACT

A system and method for controlling rate adjustment of audio data to prevent underflow or overflow. In a dual audio/video system, a device can receive two input transport streams. To prevent underflow or overflow of audio data when audio data from a first transport stream is displayed in accordance with a sample rate derived from a second transport stream, a control for rate adjustment is used to match the source sample rate with the display rate. This rate adjustment module can be designed to add or drop audio samples based on a time base comparison or on a STC, PTC, and display rate comparison.

25 Claims, 3 Drawing Sheets

CONTROL MECHANISM FOR AUDIO RATE ADJUSTMENT

BACKGROUND

1. Field of the Invention

The present invention relates generally to audio/video systems and methods and, more particularly, to different ways to control audio rate adjustment that prevents underflow or overflow.

2. Introduction

In an MPEG audio/video system, the MPEG transport stream is transmitted from the head end (via either cable or satellite). The decoder in the receiver derives its timing (time base) from the MPEG transport stream program clock reference (PCR) and uses it as its display timing. This ensures that the display timing is locked to the incoming MPEG transport stream, thereby providing a stable system with no audio/video data underflow or overflow. Details of the MPEG system are provided in ISO/IEC 13818-1, which is incorporated herein by reference in its entirety.

One example of an MPEG audio/video decoder system is shown in FIG. 1. As illustrated, transport processor 110 uses the PCR from the MPEG transport stream to generate the time base. As a result, this time base is locked to the input MPEG transport stream. The generated time base is used to generate the audio sample rate and the video display rate via audio numerical controlled oscillator (NCO) 122 and video NCO 132, respectively. The audio sample rate clock generated by audio NCO 122 is used to drive audio display 126, which displays the decoded audio PCM data generated by audio decoder 124. Similarly, the video sample rate clock generated by video NCO 132 is used to drive video display 136, which displays the decoded video data generated by video decoder 134. As both audio display 126 and video display 136 are driven by a sample rate clock derived from the input MPEG transport stream, the system is stable and there is no audio or video data underflow or overflow.

In MPEG dual real-time audio/video systems, there is a desire to display audio in a time base that is different from its source. For example, in a TV that has picture-in-picture (PIP) capability, the user might choose to switch the audio from the main audio to the PIP audio or vice versa without switching the corresponding video. When the user chooses main audio along with the main video, the display time base matches the audio source time base and the audio system is stable with no overflow or underflow of audio data. This is the scenario illustrated in FIG. 1. If the user chooses to listen to PIP audio along with the main video, however, the PIP audio will be displayed at the main time base, which can be different from the PIP time base by a few hundred parts per million (PPM). An audio PPM rate adjustment would then be needed for this usage mode to prevent audio data from entering into an underflow or overflow condition. What is needed therefore is a system and method that can control audio rate adjustment between source and display time bases.

SUMMARY

A system and/or method to control the audio rate adjustment, substantially as shown in and/or described in connection with at least one of the figures, as set forth more completely in the claims.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

Displaying audio data in a time base that is different from its source leads to potential underflow or overflow conditions. In accordance with the present invention, a control mechanism for audio rate adjustment is provided that prevents either of these conditions from occurring. In a dual real-time audio/video system two audio/video decoders are used. Each of these two audio/video decoders would include a transport processor that generates a time base that controls a display timing of audio for that particular transport stream. For example, a first transport processor in a first audio/video decoder could generate a first time base for a main audio display, while a second transport processor in a second audio/video decoder could generate a second time base for a PIP audio display. If a user switches the audio display from the main audio to the PIP audio without switching the main video, then the PIP audio samples would not be displayed in accordance with the second time base derived from the PIP input transport stream. An underflow or overflow condition could then arise.

Figure 2:
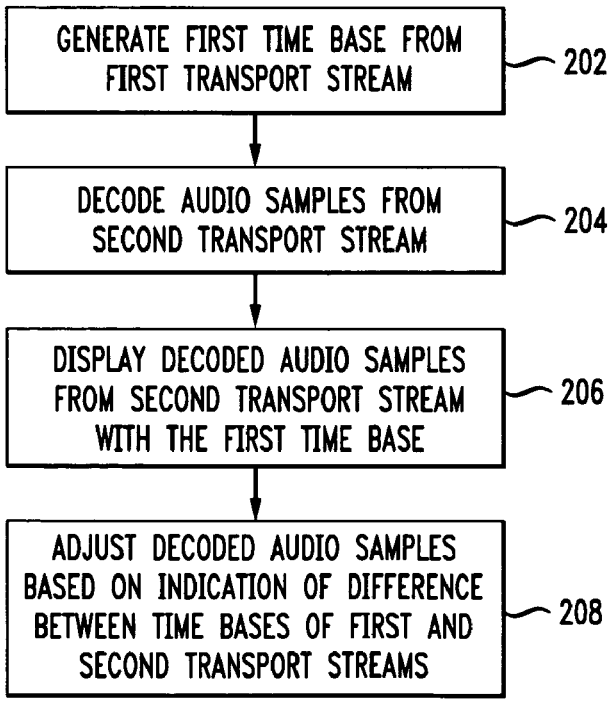
FIG. 2 illustrates a flowchart of a rate adjustment process.

To illustrate the features of the present invention, reference is first made to the flowchart of FIG. 2, which shows a control mechanism for a rate adjustment process that can be implemented in hardware, firmware, or software. As illustrated, the process begins at step 202, where a first time base that controls a display timing of audio in a first transport stream (e.g., main display) is generated in a first audio/video decoder. At step 204, audio samples carried in a second transport stream (e.g., PIP display) are decoded by a second audio/video decoder. These decoded audio samples from the second transport stream are then displayed, at step 206, in accordance with the first time base that is generated from the first transport stream. Next, at step 208, the stream of decoded audio samples from the second transport stream is adjusted based on an indication that the first time base is different from a second time base generated from the second transport stream.

In one embodiment, this adjustment mechanism is based on the removing or adding of one or more decoded audio samples. Removal of decoded audio samples can occur when a smaller number of samples are displayed as compared to the number being made available for display. Addition of decoded audio samples, on the other hand, can occur when a greater number of samples are displayed as compared to the number being made available for display.

In one embodiment, the additional samples can be based on a simple technique such as duplication. In more complex embodiments, the addition of samples can be based on the blending of other samples.

In one embodiment, control of audio rate adjustment is performed through a comparison of the source and display time base. More specifically, the source and the display time bases are compared to calculate the rate difference. Adjustments are then made to match the source audio rate with the display rate. To facilitate a comparison, both the source and the display time bases are converted to the same unit (i.e., sample rate), which facilitates the comparison. Any identified differences between the two rates can then be used to add or drop audio samples such that the source rate will match the display rate.

Figure 1:
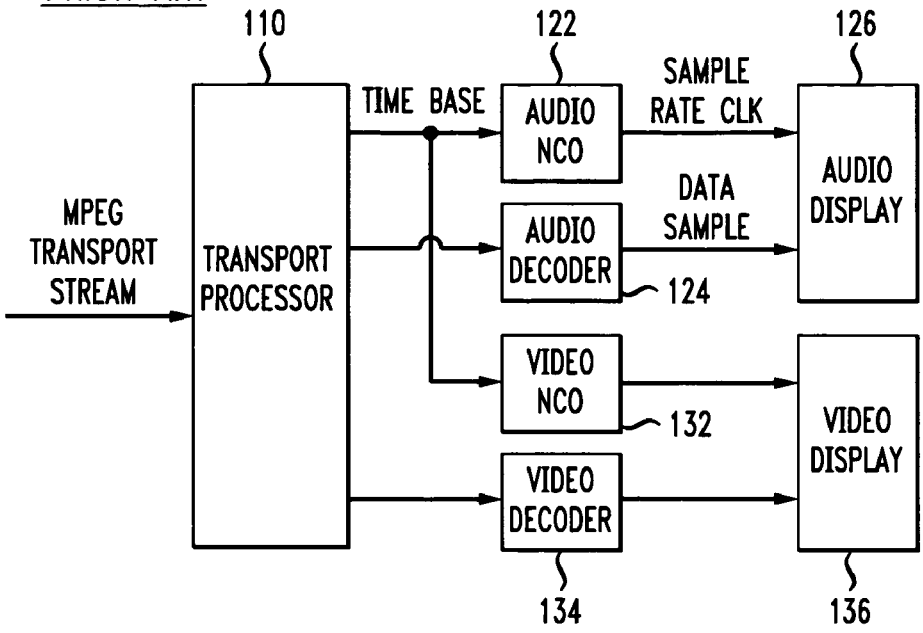
FIG. 1 PRIOR ART
FIG. 1 illustrates an embodiment of a conventional audio/video system that receives an input MPEG transport stream.
Figure 3:
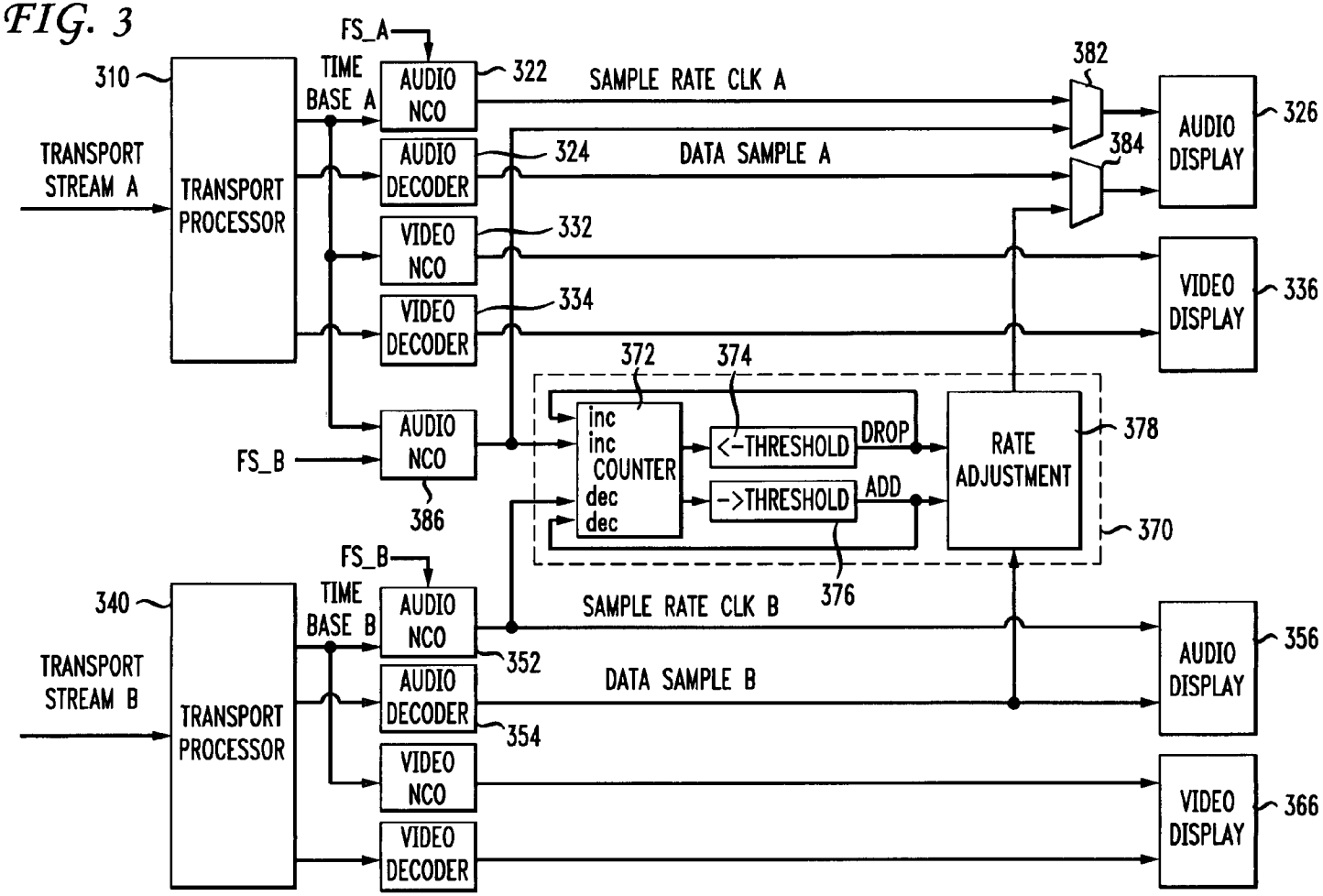
FIG. 3 illustrates a first embodiment of controlling audio rate adjustment.

FIG. 3 illustrates an embodiment of a control mechanism for audio rate adjustment based on time bases. As illustrated, the system includes two audio/video decoders, which are each similar to the decoder illustrated in FIG. 1. The first audio/video decoder receives the main display transport stream A at transport processor 310 and outputs the main audio on audio display 326 and the main video on video display 336. Similarly, the second audio/video decoder receives the PIP display transport stream B at transport processor 340 and outputs the PIP audio on audio display 356 and the PIP video on video display 366.

Each audio/video decoder's display rate locks to its input transport stream, thereby ensuring that no audio/video data overflow or underflow will occur. More specifically, transport processor 310 generates time base A from transport stream A, and transport processor 340 generates time base B from transport stream B. For MPEG transport streams, time base A and time base B can be derived from the PCR contained in the respective transport streams.

In this dual decoder arrangement, it is desired to display the PIP audio produced by audio decoder 354 on main audio display 326, while continuing to display the main video produced by video decoder 334 on main video display 336. In conventional audio/video decoder systems, main audio display 326 would display the PIP audio in accordance with time base A, which is derived from the main display input transport stream. This display arrangement can lead to underflow or overflow in the PIP audio since the PIP audio is being displayed in accordance with a time base different from the PIP source.

As is further illustrated in FIG. 3, the dual audio/video decoder system also includes the control for rate adjustment module 370, which is designed to prevent underflow or overflow in the PIP audio. To illustrate the operation of control for rate adjustment module 370, the audio sample rate (e.g., 32 kHz, 44.1 kHz, 48 kHz, 96 kHz, etc.) for stream A is designated as FS_A and the audio sample rate for stream B is designated as FS_B. These audio sample rates can be indicated by an audio rate index in the respective input transport streams.

Main audio display 326 and PIP audio display 356 output audio samples in accordance with an audio sample rate clock. PIP audio display 356 outputs PIP audio samples in accordance with an audio sample rate clock that is generated by audio NCO 352. Audio NCO 352 generates the audio sample rate clock based on time base B and FS_B.

While PIP audio display 356 is dedicated to the output of PIP audio samples, main audio display 326 can output either main audio samples or PIP audio samples. As illustrated, main audio display 326 outputs audio samples that are chosen by selector 384. Selector 384 receives main audio samples from main audio decoder 324 and PIP audio samples from PIP audio decoder 354 via rate adjustment module 370. The operation of the control for rate adjustment module 370 is described in greater detail below.

Selector 384 chooses the audio samples generated by main audio decoder 324 when main audio display 326 displays the main audio. When PIP audio is to be displayed by main audio display 326, then selector 384 would choose the PIP audio samples received via rate adjustment module 370.

To facilitate the display of PIP audio by main audio display 326, a suitable sample rate clock for the PIP audio is also made available to main audio display 326. As illustrated, the sample rate clock is generated by audio NCO 386 using time base A and FS_B. In other words, audio NCO 386 generates a sample rate clock using the audio sample rate of PIP transport stream B, but in the time base derived from main transport stream A. The generated sample rate clock generated by audio NCO 386 is made available to selector 382, which is designed to select the appropriate sample rate clock for use by audio display 326.

When main audio is displayed on main audio display 326, selector 382 would select the sample rate clock generated by audio NCO 322 and selector 384 would select the audio samples generated by audio decoder 324. When PIP audio is displayed on main audio display 326, selector 382 would select the sample rate clock generated by audio NCO 386 and selector 384 would select the rate adjusted audio samples generated by rate adjustment module 370. In the embodiment of FIG. 3, main audio display 326 can output PCM data from main audio decoder 324 or PIP audio decoder 354 without disturbing the normal operation of the PIP audio operation.

As illustrated, the sample rate clock generated by audio NCO 386, which is locked to main transport stream A, and the sample rate clock generated by audio NCO 352, which is locked to the PIP transport stream B, are applied to increment and decrement inputs, respectively, of counter 372. Any mismatch between these two input sample rate clocks is used to make a PIP audio data rate adjustment to match the PIP audio data rate to the main audio display rate. A simple increment/decrement counter 372 can be used for this purpose. In operation, the main audio display sample rate is used to increment counter 372 while the PIP audio sample rate is used to decrement counter 372.

If the PIP audio sample rate matches the main audio display rate, then counter 372 will hover around the value of zero. In this case, the PIP audio sample rate matches the main audio display rate and no rate adjustment is needed. However, if the PIP audio sample rate is faster then the main audio display rate, the counter 372 will decrement and have a negative value. This scenario is representative of the condition where the PIP audio samples are being made available by PIP audio decoder 354 at a faster rate than is being displayed by main audio display 326. If the negative value of counter 372 is determined by threshold comparator 374 to be lesser than a negative value of a programmable threshold, then a PIP audio sample is dropped by rate adjustment module 378. This rate adjustment removes a PIP audio sample so that the PIP audio sample rate matches the main audio display rate. At the same time as the dropping of the PIP audio sample, counter 372 is also incremented to account for the dropped sample.

Similarly, if the PIP audio sample rate is slower than the main audio display rate, then counter 372 will increment. If this value is determined by threshold comparator 376 to be greater than a positive value of a programmable threshold, then a PIP audio sample should be added by rate adjustment module 378. This scenario is representative of the condition where the PIP audio samples are being made available by PIP audio decoder 354 at a slower rate than is being displayed by main audio display 326. This adjustment adds a PIP audio sample so that the PIP audio sample rate matches the main audio display rate. At the same time as the adding of the PIP audio sample, counter 372 is also decremented to account for the added sample.

In one embodiment, rate adjustment module 378 can be designed to repeat audio samples or drop audio samples. In an alternative embodiment, rate adjustment module 378 can be designed to use blending of PCM data to add or drop samples to improve sound quality during a rate adjustment.

It should be noted that in the embodiment of FIG. 3, the control of rate adjustment is based on an analysis based on sample rate clocks generated using FS_B. As would be appreciated, the control of rate adjustment can also be based on sample rate clocks generated using FS_A with the appropriate sample rate conversion being applied.

In another embodiment, the control of rate adjustment can be performed by considering the system time clock (STC), presentation time stamp (PTS), and the display rate. In this process, the three parameters STC, PTS and display rate can be used to calculate the rate difference between the source and display time bases.

In an MPEG system, an audio frame with a PTS is displayed when the STC=PTS. STC is normally locked to the input transport stream, which is the source time base. Thus, between any two consecutive PTSs (i.e., T period interval), there should be a fixed number (Y) of audio samples to be displayed. During this T period interval, it is assumed that the number of audio samples displayed is Z. If Y=Z, then the source rate and display rate match. If Z<Y, then one or more audio samples should be dropped to match the source rate to the display rate. If Z>Y, then one or more audio samples should be added to match the source rate to the display rate.

Figure 4:
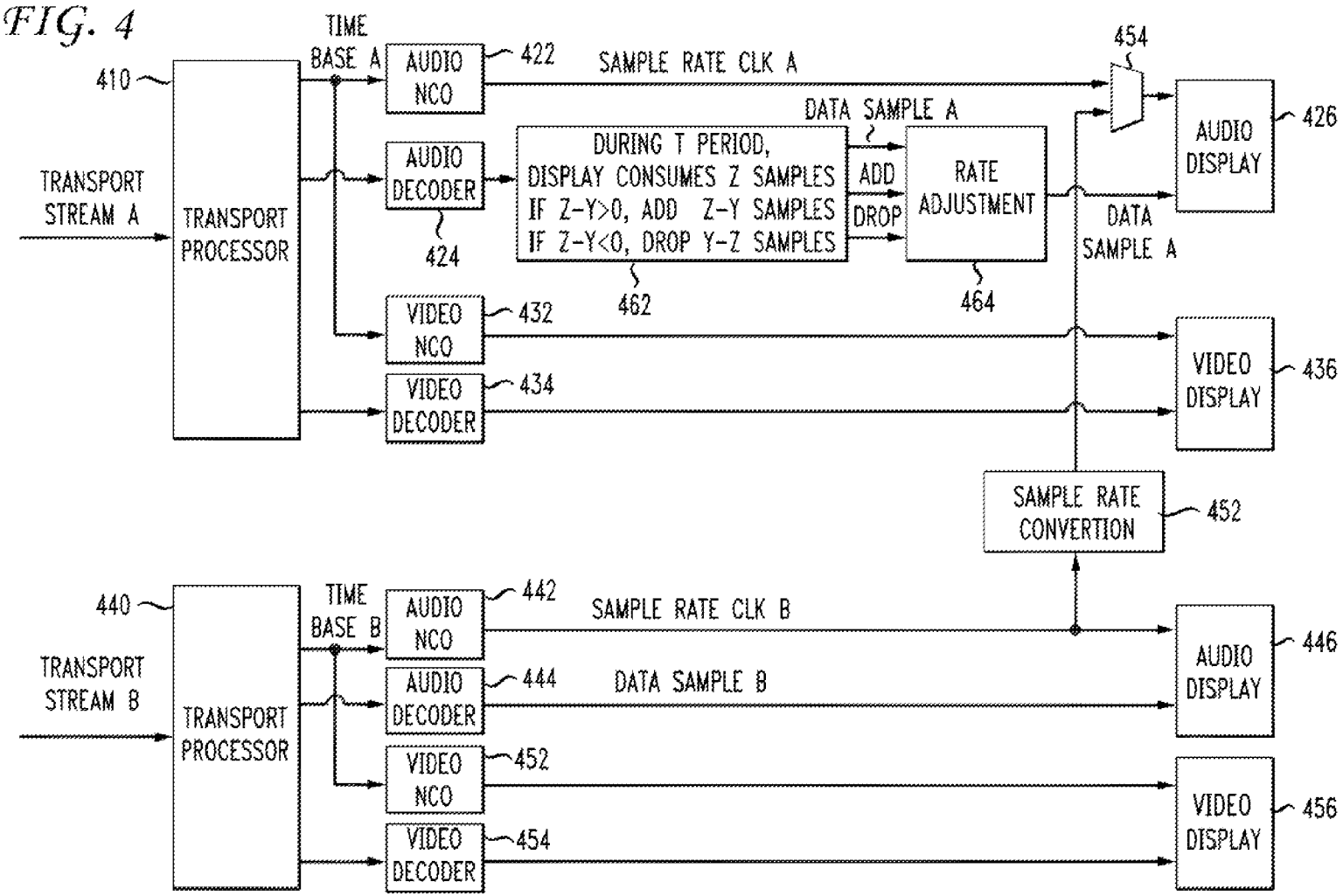
FIG. 4 illustrates a second embodiment of controlling audio rate adjustment.

FIG. 4 illustrates an embodiment of a control mechanism for audio rate adjustment based on STC, PTS and the display rate. As illustrated, the system again includes two audio/video decoders, which are each similar to the decoder illustrated in FIG. 1. The first audio/video decoder receives the PIP display transport stream A at transport processor 410 and outputs the PIP audio on PIP audio display 426 and the PIP video on PIP video display 436. Similarly, the second audio/video decoder receives the main display transport stream B at transport processor 440 and outputs the main audio on audio display 446 and the PIP video on video display 456.

Each audio/video decoder's display rate locks to its input transport stream. More specifically, transport processor 410 generates time base A from transport stream A, and transport processor 440 generates time base B from transport stream B.

In this dual decoder arrangement, PIP audio display can display PIP audio samples based on a sample rate clock derived from PIP transport stream A or main transport stream B. This choice of sample rate clock is enabled via selector 454.

If it is desired to display the PIP audio while continuing to display the main video produced by video decoder 454 on main video display 456, then the display of PIP audio is in accordance with the sample rate clock generated by audio NCO 442 from main transport stream B. As illustrated in FIG. 4, the sample rate clock generated by audio NCO 442 is first converted by sample rate conversion 452 prior to its receipt by selector 254. In this process, sample rate conversion 452 converts the sample rate clock from one derived from FS_B to one derived from FS_A. For example, if sample rate A is 48 kHz and sample rate B at 32 kHz, then sample rate B should be converted to 48 khz by sample rate conversion 452 multiplying sample rate B by 3/2.

To prevent underflow or overflow of PIP audio samples when displayed in accordance with a sample rate clock generated from main transport stream B, rate adjustment of the PIP audio samples is needed. This rate adjustment is effected via rate adjustment module 464, which is under control of rate analysis module 462. In one embodiment, rate analysis module 464 is embodied in firmware using processor control.

In operation, rate analysis module would consider the parameters STC, PTS and the display rate to calculate the rate difference between the source and display time bases. When a PTS is equal STC, Y number of PCM samples is produced from decoding compressed audio data. During the time period T between any two consecutive PTSs, from the STC=current PTS to STC=next PTS, the audio display will consume Z samples. Rate analysis module 462 then determines if Z−Y is greater than or less than zero. If Z−Y is greater than zero, then rate analysis module 462 would instruct rate adjustment module 464 to add Z-Y audio samples to match the source rate to the display rate. If Z−Y is less than zero, then rate analysis module 462 would instruct rate adjustment module 464 to drop Y−Z audio samples to match the source rate to the display rate. In one embodiment, the calculation of Z can be based on the amount of data in the display FIFO when STC=PTS.

These and other aspects of the present invention will become apparent to those skilled in the art by a review of the preceding detailed description. Although a number of salient features of the present invention have been described above, the invention is capable of other embodiments and of being practiced and carried out in various ways that would be apparent to one of ordinary skill in the art after reading the disclosed invention, therefore the above description should not be considered to be exclusive of these other embodiments. Also, it is to be understood that the phraseology and terminology employed herein are for the purposes of description and should not be regarded as limiting.

What is claimed is:

1. A method of controlling audio rate adjustment in a device having a first and a second audio/video decoder, comprising:

generating, in a first transport processor of the first audio/video decoder, a first time base that controls a display timing of audio in a first transport stream received by the first audio/video decoder;

generating, by a first numerical controlled oscillator, a first sample rate clock using said first time base and a first sampling rate determined from said first transport stream;

generating, in a second transport processor of the second audio/video decoder, a second time base that controls a display timing of audio in a second transport stream received by the second audio/video decoder;

generating, by a second numerical controlled oscillator, a second sample rate clock using said second time base and a second sampling rate determined from said second transport stream;

decoding, in the first audio/video decoder, first audio samples carried in said first transport stream;

decoding, in the second audio/video decoder, second audio samples carried in said second transport stream;

displaying said second decoded audio samples from said second transport stream, in place of said first decoded audio samples, in accordance with a third sample rate clock generated using said first time base and said second sampling rate determined from said second transport stream; and adjusting said second decoded audio samples based on an indication that said first sample rate clock is different from said third sample rate clock.

2. The method of claim 1, wherein said adjusting comprises removing one or more decoded audio samples.

3. The method of claim 2, wherein said adjusting comprises removing one decoded audio samples.

4. The method of claim 1, wherein said adjusting comprises adding one or more decoded audio samples.

5. The method of claim 4, wherein said adjusting comprises adding one decoded audio sample.

6. The method of claim 1, wherein said adjusting comprises blending of audio samples.

7. The method of claim 1, wherein said adjusting comprises adjusting said second decoded audio samples based on an indication that a value of a counter that is incremented based on a signal derived from said third sample rate clock and decremented based on a signal derived from said second sample rate clock is greater than a first threshold or less than a second threshold.

8. The method of claim 1, wherein said adjusting comprises adding or dropping audio samples to a display FIFO based on a difference of a number of audio samples displayed in a time period and a number of audio samples made available for display in said time period.

9. The method of claim 8, wherein said adjusting comprises adding one or more audio samples if said number of audio samples displayed in said time period is greater than said number of audio samples made available for display in said time period.

10. The method of claim 8, wherein said adjusting comprises dropping one or more audio samples if said number of audio samples displayed in said time period is less than said number of audio samples made available for display in said time period.

11. The method of claim 1, further comprising generating said third sample rate clock using a third numerical controlled oscillator.

12. The method of claim 1, further comprising generating said third sample rate clock based on said first sample rate clock.

13. The method of claim 1, wherein said generating a time base comprises generated based on a program clock reference field in a transport stream.

14. An audio rate adjustment system, comprising:

a first transport processor that generates a first time base that controls a display timing of audio in a first transport stream received by said first transport processor;

a first numerical controlled oscillator that generates a first sample rate clock signal using said first time base based on a first sampling rate determined from said first transport stream;

a second transport processor that generates a second time base that controls a display timing of audio in a second transport stream received by said second transport processor;

a second numerical controlled oscillator that generates a second sample rate clock signal using said second time base and a second sampling rate determined from said second transport stream;

an audio display that displays second decoded audio samples from said second transport stream, in place of first decoded audio samples from said first transport stream, in accordance with a third sample rate clock signal generated using said first time base and said second sampling rate;

a counter that is incremented based on a signal derived from said third sample rate clock and decremented based on a signal derived from said second sample rate clock;

a comparator module that compares a value of said counter to one or more thresholds; and a rate adjustment module that adjusts said second decoded audio samples from said second transport stream based on results of said comparator module.

15. The system of claim 14, wherein said comparator module comprises:

a first comparator that determines whether a value of said counter is less than a first threshold; and a second comparator that determines whether a value of said counter is greater than a second threshold.

16. The system of claim 15, wherein said rate adjustment module drops a decoded audio sample if said first comparator indicates that a value of said counter is less than said first threshold, and adds an audio sample if said second comparator indicates that a value of said counter is greater than said second threshold.

17. The system of claim 16, wherein a drop indication by said first comparator increments said counter and an add indication by said second comparator decrements said counter.

18. The system of claim 14, wherein said counter operates at a sample rate indicated by said first transport stream.

19. The system of claim 14, wherein said counter operates at a sample rate indicated by said second transport stream.

20. The system of claim 14, further comprising a third numerical controlled oscillator that generates said third sample rate clock using said first time base and said second sampling rate.

21. The system of claim 14, further comprising a sample rate clock selector that selects between said first sample rate clock and said third sample rate clock.

22. A method of controlling audio rate adjustment in a device having a first audio/video decoder that receives a first transport stream and a second audio/video decoder that receives a second transport stream, comprising:

identifying a first number of audio samples that are displayed in a time period in accordance with a sample rate clock generated by a numerical controlled oscillator using a first time base generated from the first transport stream and a sampling rate determined from said second transport stream, wherein said displayed audio samples are decoded from said second transport stream instead of said first transport stream;

identifying a second number of audio samples from said second transport stream that are made available for display in said time period; and adjusting a number of audio samples in a display first-in-first-out (FIFO) based on a difference between said identified first and second number of audio samples.

23. The method of claim 22, wherein said adjusting comprises adding a number of audio samples to said display FIFO based on said difference.

24. The method of claim 22, wherein said adjusting comprises dropping a number of audio samples from said display FIFO based on said difference.

25. The method of claim 22, wherein said time period is defined by a first and a second presentation time stamp in an MPEG transport stream.

* * * * *